US012268250B1

(12) United States Patent
Antoin

(10) Patent No.: US 12,268,250 B1
(45) Date of Patent: Apr. 8, 2025

(54) MALE UNDERWEAR SYSTEMS, KITS, ASSEMBLIES, COMPONENTS, AND METHODS

(71) Applicant: Christopher Farook Antoin, Los Angeles, CA (US)

(72) Inventor: Christopher Farook Antoin, Los Angeles, CA (US)

( * ) Notice: Subject to any disclaimer, the term of this patent is extended or adjusted under 35 U.S.C. 154(b) by 0 days.

(21) Appl. No.: 18/615,144

(22) Filed: Mar. 25, 2024

Related U.S. Application Data

(63) Continuation-in-part of application No. 18/605,664, filed on Mar. 14, 2024, now abandoned.

(60) Provisional application No. 63/451,924, filed on Mar. 14, 2023.

(51) Int. Cl.
*A41B 9/02* (2006.01)
*A41B 9/14* (2006.01)

(52) U.S. Cl.
CPC ..... *A41B 9/023* (2013.01); *A41B 9/02* (2013.01); *A41B 9/026* (2013.01); *A41B 9/14* (2013.01)

(58) Field of Classification Search
CPC ..... A41B 9/023; A41B 9/02; A41B 9/026; A41B 9/14
See application file for complete search history.

(56) References Cited

U.S. PATENT DOCUMENTS 1,661,072 A * 2/1928 Hutchinson ..... A41B 9/02 2/405
2,319,138 A * 5/1943 Kneibler ..... A41B 9/02 2/405
3,194,241 A * 7/1965 Leoffel ..... A41C 1/003 2/407
3,739,398 A * 6/1973 Sarmiento ..... A41B 9/04 2/407
6,145,132 A * 11/2000 Towner ..... A41B 9/02 2/400
6,892,399 B1 * 5/2005 Rocha ..... A41D 1/06 2/234
11,096,430 B2 * 8/2021 Otashevich ..... A41D 1/06
11,272,744 B2 * 3/2022 Shaughnessy ..... A41B 9/004
11,653,705 B2 * 5/2023 McCombs ..... A41B 9/023 2/403
2001/0035032 A1 * 11/2001 Blakely ..... D04B 1/243 66/177

(Continued)

FOREIGN PATENT DOCUMENTS

EP 1668997 A2 * 6/2006 ..... A41B 9/02
GB 2474558 A * 4/2011 ..... A41B 9/02

*Primary Examiner* — Khaled Annis
(74) *Attorney, Agent, or Firm* — Newman LLP

(57) ABSTRACT

A men's underwear assembly may include a waistband, left and right leg portions, left and right elastic bands, and a brief portion. The brief portion may include left and right side panels and. The panels may join at a seam, configured to encircle a waist, with a front portion at least partially defining a genital pocket. Left and right leg portions may be configured to encircle portions of the wearer's left and right legs. Each leg portion may have an upper peripheral edge region and a lower peripheral edge region, with the upper peripheral edge region of each leg attached to corresponding left and right leg openings. Left and right elastic bands may fasten jointly and peripherally to the left and right openings and to the left and right upper peripheral edge regions, defining respective left and right elastic boundaries of the genital pocket.

9 Claims, 7 Drawing Sheets

(56) References Cited

U.S. PATENT DOCUMENTS

| | | | | |
|---|---|---|---|---|
| 2002/0115378 | A1* | 8/2002 | Nagaoka | A41C 1/00 450/115 |
| 2003/0196252 | A1* | 10/2003 | Blakely | A41C 1/003 2/400 |
| 2005/0229293 | A1* | 10/2005 | Miller | A41D 1/089 2/403 |
| 2005/0235399 | A1* | 10/2005 | Kang | A41B 9/023 2/403 |
| 2006/0162052 | A1* | 7/2006 | Stankowski | A41B 9/02 2/403 |
| 2007/0079427 | A1* | 4/2007 | Herbert | A41B 9/00 2/403 |
| 2009/0300826 | A1* | 12/2009 | Harimoto | A41B 9/02 2/403 |
| 2011/0307996 | A1* | 12/2011 | Radford | A41B 9/02 2/403 |
| 2012/0240311 | A1* | 9/2012 | Baylo | A41B 9/02 2/227 |
| 2014/0331390 | A1* | 11/2014 | Matsumoto | A41B 9/023 2/403 |
| 2015/0164151 | A1* | 6/2015 | James | A41D 1/06 450/95 |
| 2017/0238619 | A1* | 8/2017 | Shupe | A41B 9/023 |
| 2018/0055096 | A1* | 3/2018 | Chan | A41B 9/023 |
| 2018/0310633 | A1* | 11/2018 | Harris | A41B 9/026 |
| 2019/0387809 | A1* | 12/2019 | Perry | A41B 17/00 |
| 2020/0237020 | A1* | 7/2020 | McCombs | A41B 9/02 |
| 2020/0297040 | A1* | 9/2020 | Weber-Unger | A41B 9/02 |
| 2020/0305515 | A1* | 10/2020 | Bradley | A41B 9/001 |
| 2021/0259326 | A1* | 8/2021 | Shaughnessy | A41B 9/023 |
| 2022/0346461 | A1* | 11/2022 | Wittrock | G06Q 30/0621 |

* cited by examiner

MALE UNDERWEAR SYSTEMS, KITS, ASSEMBLIES, COMPONENTS, AND METHODS

RELATED APPLICATIONS

The present application is a continuation in part of U.S. patent application Ser. No. 18/605,664 filed Mar. 14, 2024, which claims priority to Provisional Patent Application 63/451,924 filed Mar. 14, 2023. Each of these applications is incorporated herein in its entirety.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright © 2024, CHRISTOPHER ANTOIN.

TECHNICAL FIELD

Various aspects of this disclosure relate to men's, or male, undergarments, particularly men's brief.

BACKGROUND

Conventionally, there are three types of male underwear: boxers, briefs and boxer briefs-a hybrid combination of boxers and briefs. The present inventor has recognized that each suffers from one or more drawbacks. For example, boxers provide ample fabric to cover a man's upper thighs and groin area to prevent his thighs from chafing each other, but fail not only to prevent genital-to-thigh chafing, but also to provide adequate genital support. Lack of genital support often result in pinching and other genital discomfort as men move. Briefs, on the other hand, typically provide greater support and containment of men's genitals during movement, but leave upper thighs uncovered and thus lead to thigh-to-thigh chafing. And boxer briefs, a hybrid combination of the boxer with the brief, fail to provide sufficient genital support to prevent thigh-to-genital chafing and can also fail sometimes to prevent thigh-to-thigh chafing.

Accordingly, the present inventor has identified a need for an improved form of men's underwear.

SUMMARY

To address one or more of these and/or other needs or problems, the present inventor devised, among other things, one or more exemplary systems, kits, methods, devices, assemblies, and components related to men's underwear. For example, some embodiments of the current invention provide a men's underwear structure comprising a male brief structure and left and right leg structures. The brief structure is bounded by a waist band and upper left and upper right elastic leg bands having front and rear portions, with the front band portions defining left and right seams of a crotch pocket and the rear band portions supporting respective left and right buttocks. In some embodiments, each upper leg band includes an intermediate side portion joining the front and rear portions to form a closed loop, with the side portion spaced below the waist band and above a lower most region of the crotch pocket. In some embodiments, the front and rear portions of each leg band terminate at or near the waist band, with the front terminal portions of the left and right bands spaced closer together than the rear ones. The left leg structures or tube extends between the upper left elastic leg band and a lower left elastic leg band, and the right leg tube extends between the upper right elastic leg band and a lower right elastic leg band. Additionally, a frontal crotch or gusset area, contoured to support and cover a male wearer's genitals, extends between the upper left and right leg bands and the waist band.

In some embodiments, the lower right and left elastic leg bands are positioned between the upper leg bands and knees of the wearer, whereas in other embodiments having longer leg structures these lower bands may be positioned between the knees and ankles. And still other embodiments, for example, those formed from panels of an elastic fabric, such as spandex or elastane, may provide the extended and non-extended left and right leg structures without the lower elastic bands, relying on the inherent elasticity of the panels to secure position of the legs of the underwear relative to the wearer's legs.

In some embodiments, the brief and leg structures are formed of a 100% spandex or elastane textile, a blend of spandex and one or more other fibers, for example cotton, hemp, or bamboo. The elastic bands, which may generally be braided, knitted, woven, transparent, or some combination thereof. In some embodiments, the elastic bands can stretch up to 2, 3, or 4 times their resting length as compared to the adjacent brief or leg fabric which if made of 100% spandex can stretch up to 8 times. In some embodiments, the spring constant of the elastic bands is at least 25, 50, 75% or 100% greater than that of the brief or leg fabric that its attached to.

BRIEF DESCRIPTION OF THE DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION OF EXEMPLARY EMBODIMENTS

This document, which incorporates drawings and claims, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figures 1A, 1B, 1C:
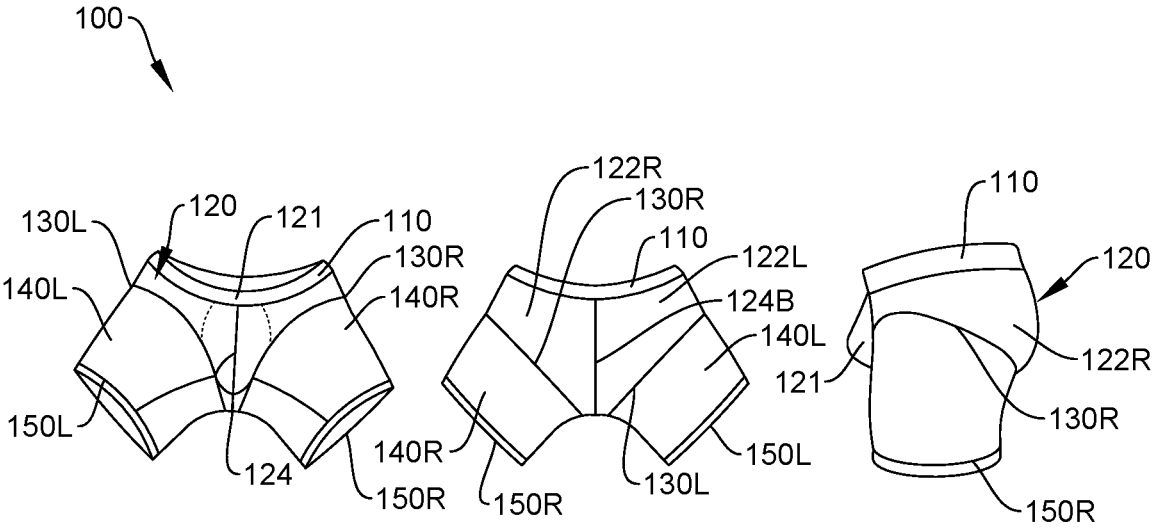
FIG. 1A is a front view of an exemplary male underwear structure or assembly 100, corresponding to one or more embodiments of the invention.
FIG. 1B is back view of male underwear structure 100, corresponding to one or more embodiments of the present invention.
FIG. 1C is a right side view of male underwear structure 100, corresponding to one or more embodiments of the present invention.

FIGS. 1A, 1B, and 1C show respective front, back, and side views of an exemplary men's underwear structure or assembly 100. (In some embodiments, the left and right side views of the assembly are mirror images of each other.) Assembly 100 includes a waist band 110, brief or body portion 120, upper elastic leg bands 130R and 130L, right and left leg portions 140R and 140L, and lower elastic leg bands 150R and 150L. Waist band 110, which takes the exemplary form of a covered or uncovered one-inch-wide knit elastic, is configured to encircle the waist or more generally the lower torso region of a male user, forms an upper boundary of brief portion 120. Brief portion 120, which includes a central crotch pocket or pouch area 121, includes left and right side panels 122R and 122L joined together via a central seam 124. Central seam 124 includes a front portion 124F and a back portion 124B, which define the front and back rise of the underwear. In some medium-sized variants of the underwear these are respectively about 11.5 and 13.5 inches measured to the top of the waist band. Side panels 122R and 122L, which respectively wrap around the right and left hip and buttocks of the wearer, are joined via respective upper elastic bands 130R and 130L to respective right and left leg portions 140R and 140L. The upper elastic bands, which for example take the form of quarter-inch wide braided elastic, not only define the rearmost boundaries of crotch pocket 121, but also provide a secure and comfortable containment of the wearer's genitalia. Moreover, in some embodiments, the inward, left-to-right pull of band 130R combined with the inward, right-to-left pull of band 130L provides or supports an outward or forward projection of the genitalia, ultimately producing an enhanced sense of size for both the wearer and interested observers.

Leg portions 140R and 140L each have a generally tubular structure and extend downward from the upper bands a desire length, for example a length sufficient to reach the mid-thigh portion of a wear's legs. At the desired length, leg portions 140R and 140L are terminated via respective lower elastic bands 150R and 150L, thereby inhibiting movement of the leg structures relative to the right and left legs of a wear and providing an enhanced sense of comfort and security.

In some embodiments, the leg portions are formed of the same textile as brief portion 120, for example a 100% spandex textile, a blend of spandex and one or more other fibers, for example cotton, hemp, or bamboo. Some embodiments form the brief portion and the leg portions from a moisture management spandex, such as M-110AM from SpandexByYard. In the case of high spandex content, for example in excess of 50% or 75%, some embodiments omit the lower elastic bands. Also some embodiments may position the upper and lower elastic bands on the interior or the exterior of the assembly for aesthetic and/or functional reasons. For example, as shown and described in detail using FIG. 9, the elastic band may be integrated in the peripheral edge of the leg opening in the brief or the tubular leg structure by folding over the edge, sewing the folded over Additionally, some embodiments use elastic having enhanced frictional characteristics, such as silicone or other similar thermoplastic gripping dots or strips, to further inhibit movement of the garment, particularly the leg portions, relative to the wearer.

Figures 2A, 2B:
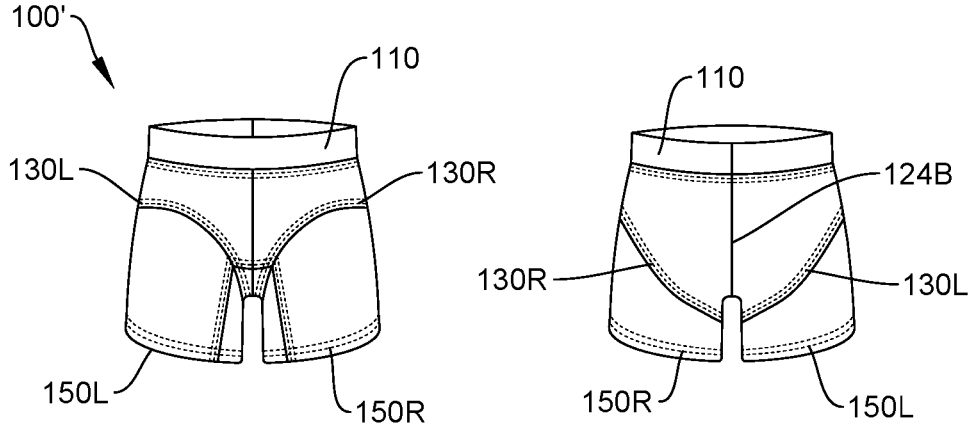
FIG. 2A is a front view of male underwear structure 100', corresponding to one or more embodiments of the present invention.
FIG. 2B is a back view of male underwear structure 100', corresponding to one or more embodiments of the present invention.

FIGS. 2A and 2B show respective front and back views of a men's underwear assembly 100', representing two variants of the assembly 100 via use of double broken lines. In a first variant, the double broken lines represent a quarter- or half-inch double-needle overstitching at the waistband 110, upper elastic leg bands 130R and 130L, and lower elastic leg bands 150R and 150L. In a second variant, the double broken lines represent external position of the upper and lower elastic bands.

Figure 3:
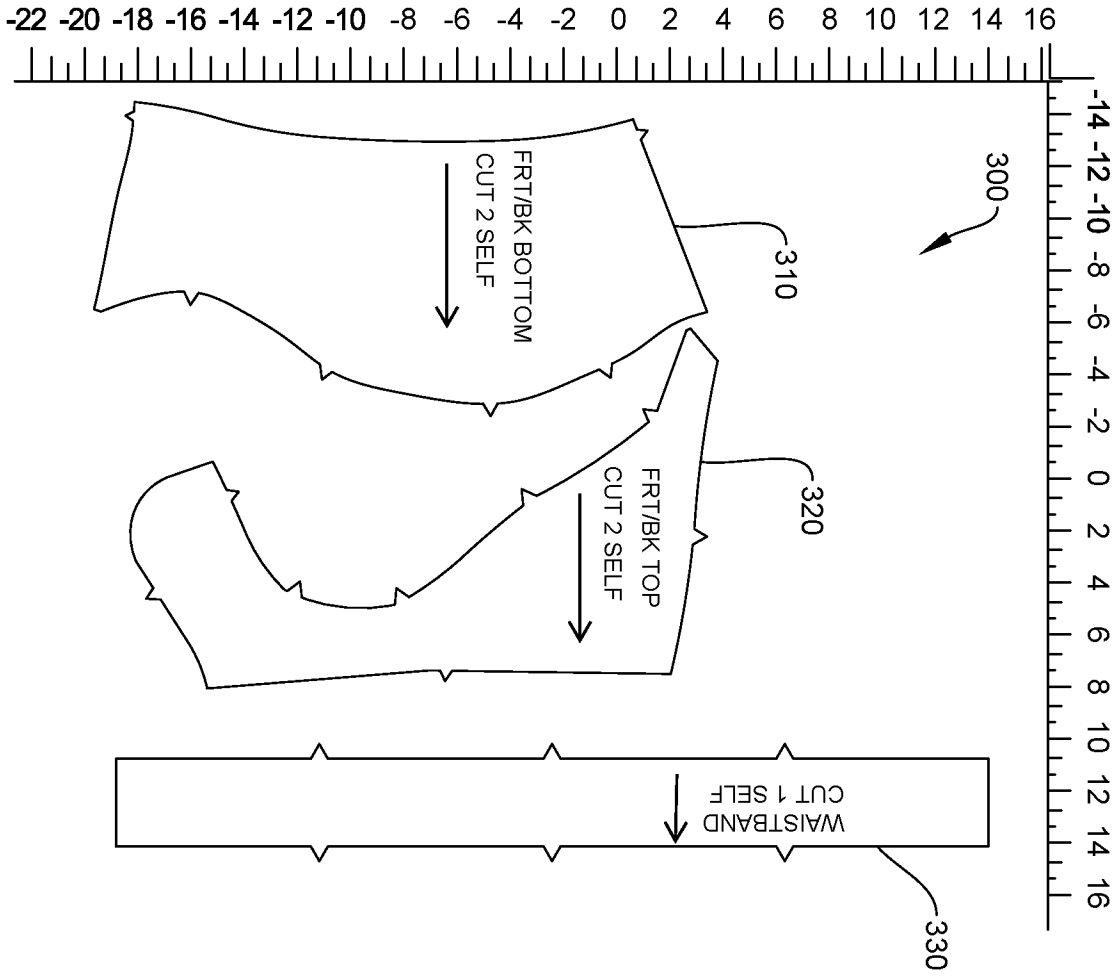
FIG. 3 is a plan view of a sewing pattern 300 suitable for use in manufacturing male underwear structures 100 and 100' and also corresponding to one or more embodiments of the present invention.

FIG. 3 shows an exemplary sewing pattern 300 for use in constructing the underwear assembly 100 and/or 100'. Pattern 300 includes a front-back bottom piece 310, a front-back top piece 320, and a waistband cover piece 330. Two of the front-back top and bottom pieces and one waistband are needed to complete assembly. The waistband piece 330 is configured to define an cover or case for an elastic waist band and then sewn separately to a top region of the brief or body of the underwear assembly, thereby providing a more comfortable interface with the wearer's skin than a conventional elastic band interface. Exemplary manufacturing instructions include providing quarter-inch seam allowance on all body, quarter inch four-thread overlock on all body, quarter-inch double-needle coverstitch on waist and leg, and half-inch double needle coverstitch on hem.

Figure 4A:
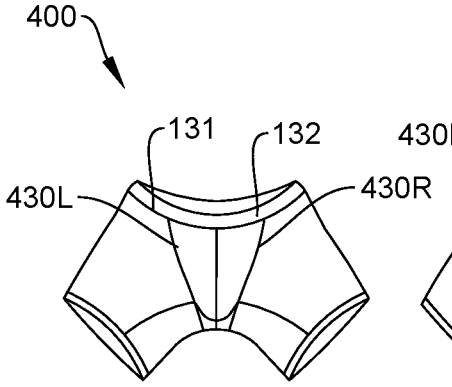
FIG. 4A is a front view of an exemplary male underwear structure or assembly 400, corresponding to one or more embodiments of the invention.
Figure 4B:
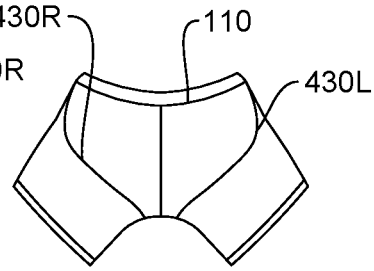
FIG. 4B is back view of male underwear structure 400, corresponding to one or more embodiments of the present invention.
Figure 4C:
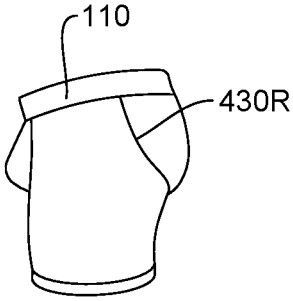
FIG. 4C is a right side view of male underwear structure 400, corresponding to one or more embodiments of the present invention.

FIGS. 4A, 4B, and 4C show respective front, back, and side views of an exemplary men's underwear structure or assembly 400, which is identical to assembly 100 in all respects except for its upper right and left elastic leg bands 430R and 430L. In contrast to the upper elastic bands 130R and 130L of assembly 100 which form a closed loop around the left and right legs of a wear, bands 430R and 430L start at respective front positions 131 and 132 near or on waist band 130 and end at respective back positions 133 and 134 near or on waist band 130. In some embodiments, this positioning provides both enhanced genital support and containment as well as enhanced aesthetics.

Figure 5A:
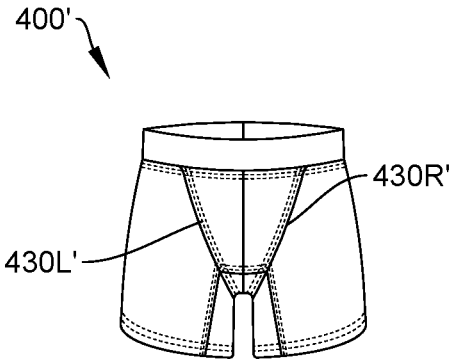
FIG. 5A is a front view of male underwear structure 400', corresponding to one or more embodiments of the present invention.
Figure 5B:
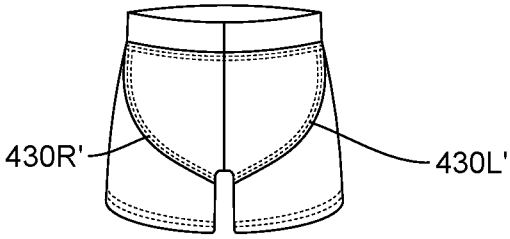
FIG. 5B is a back view of male underwear structure 400', corresponding to one or more embodiments of the present invention.

FIGS. 5A and 5B show respective front and back views of a men's underwear assembly 400', representing two variants of the assembly 400 via use of double broken lines. In a first variant, the double broken lines represent double needle overstitching at the waistband 110, upper elastic leg bands 430R and 430L, and lower elastic leg bands 150R and 150L. In a second variant, the double broken lines represent external position of the upper and/or lower elastic bands.

Figure 6:
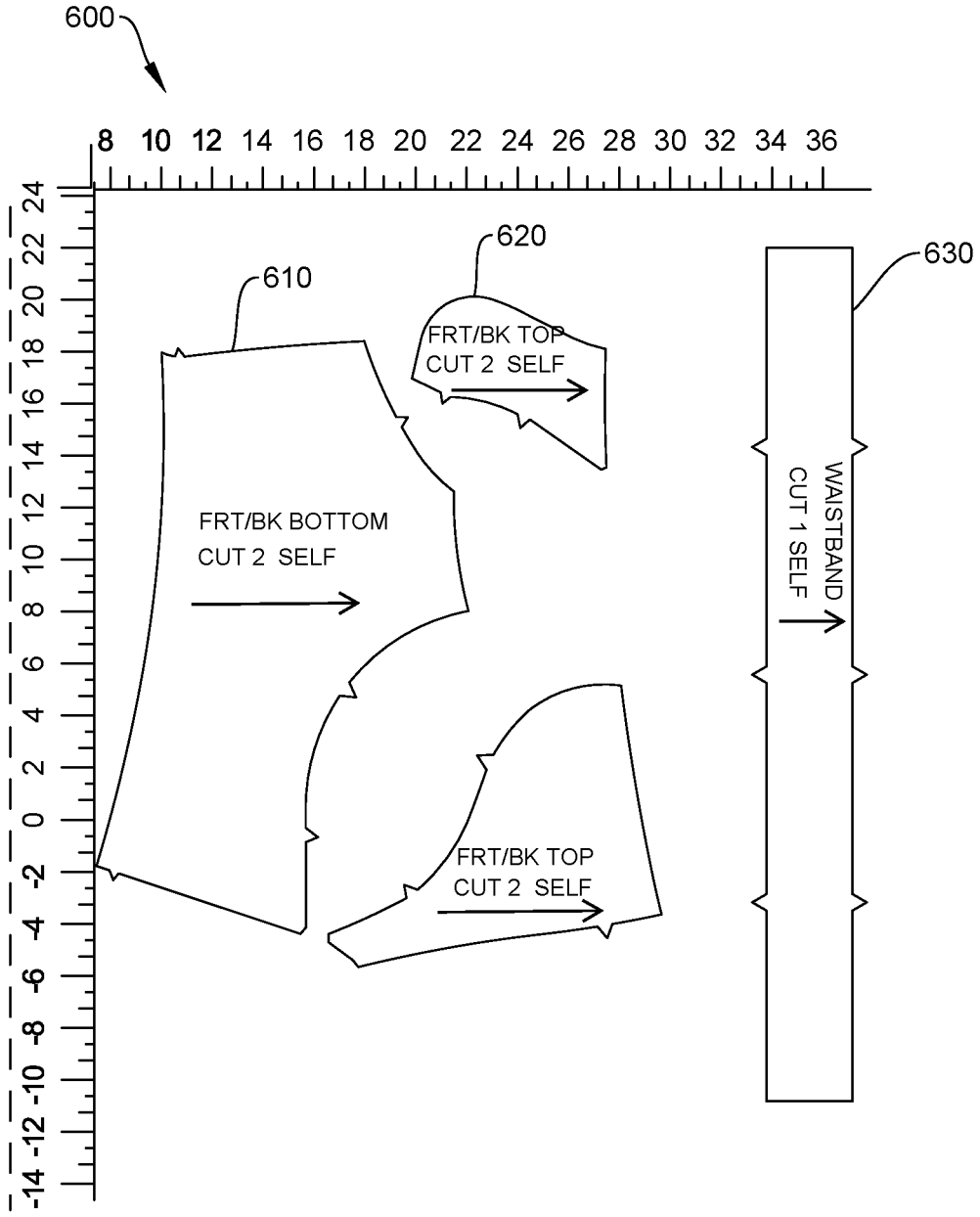
FIG. 6 is a plan view of a sewing pattern 600 suitable for use in manufacturing male underwear structures 400 and 400' and also corresponding to one or more embodiments of the present invention.

FIG. 6 shows an exemplary sewing pattern 600 for use in constructing the underwear assembly 400 and/or 400'. Use of this pattern is similar to pattern 300.

Figure 7A:
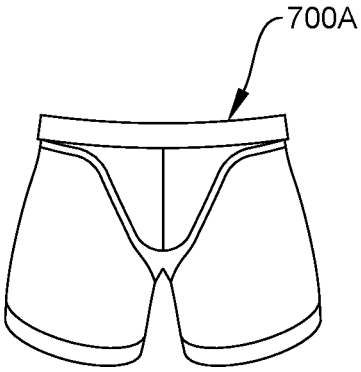
FIGS. 7A, 7B, and 7C are respective front views of different leg-length variants of underwear assembly 100.
Figure 7B:
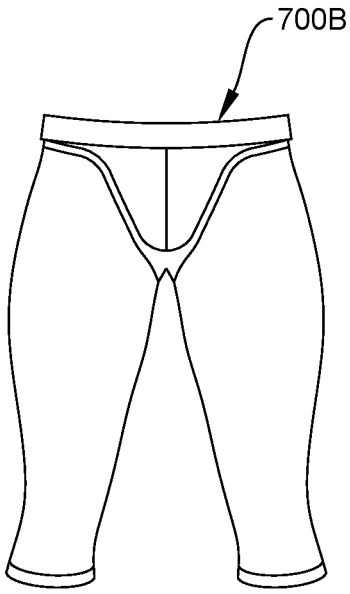
Figure 7C:
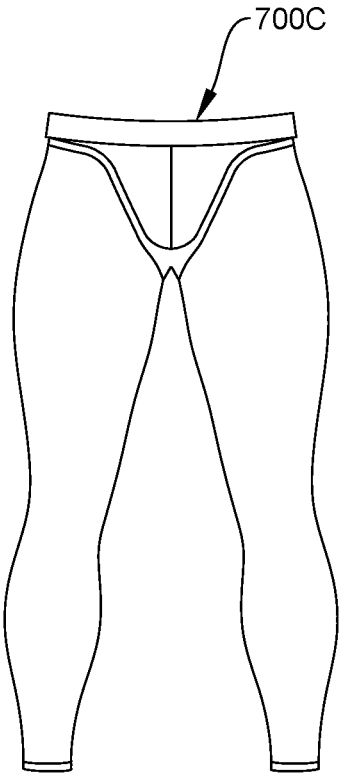
Figure 8A:
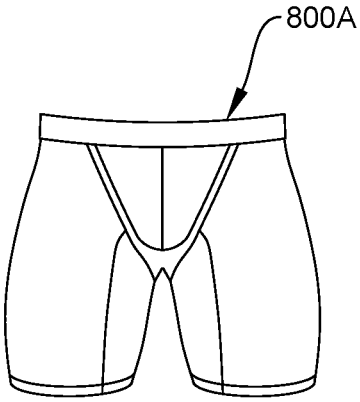
FIGS. 8A, 8B, and 8C are respective front views of different leg-length variants of underwear assembly 400.
Figure 8B:
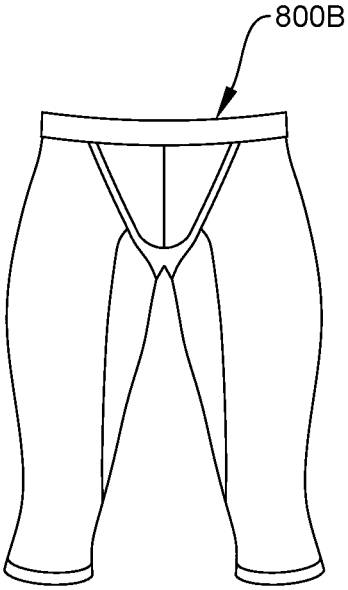
Figure 8C:
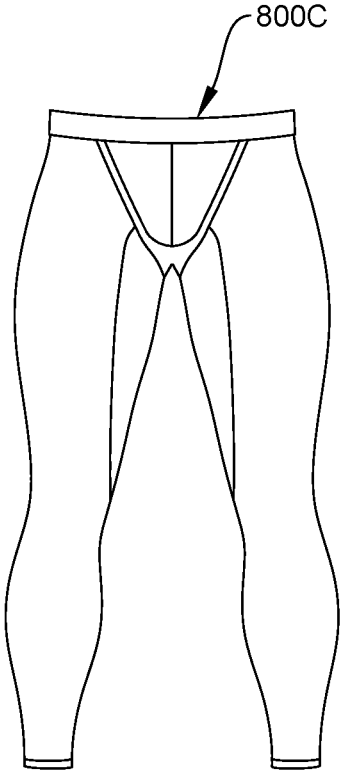

FIGS. 7A, 7B, and 7C show respective variants 700A, 700B, and 7000 of underwear assembly 100, each having a different length leg portion between its upper and lower elastic bands. Similarly, FIGS. 8A, 8B, and 8C show respective longer-leg variants 800A, 800B, and 8000 of assembly 400.

Figure 9:
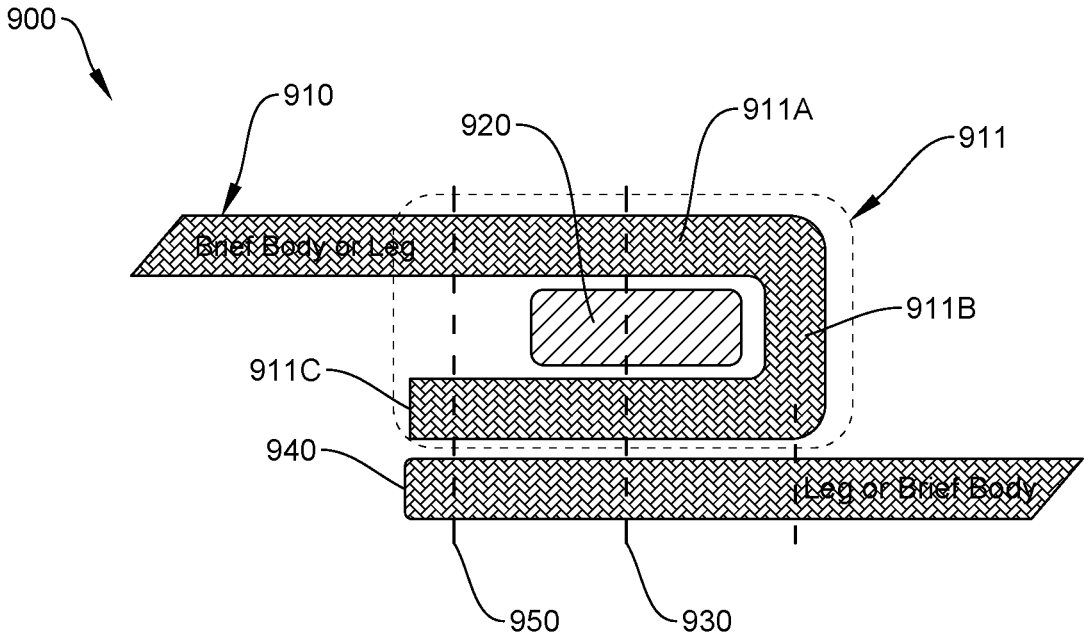
FIG. 9 is a cross-sectional view of an exemplary elasticized seam structure 900 suitable for use with the elastic bands of the underwear structures described herein, and thus corresponding to one or more embodiments of the present invention.

FIG. 9 shows a conceptual cross-sectional view of an exemplary elasticized seam structure 900 for in incorporating the elastic bands at the juncture of the brief body and legs in some embodiments of the underwear structures described herein. (The cross-section is taken in a dimension perpendicular to the longitudinal direction of the elastic band.). Seam structure 900 includes a brief or leg portion 910, an elastic band 920, a stitch line 930, an adjoining leg or brief portion 940, and stitch lines 950. Brief or leg portion 910 includes a peripheral edge fold 911 having a top fold portion 911A, a fold edge 911B, and a bottom fold portion 911C. Elastic band 920 is sandwiched between top fold portion 911A and bottom fold portion 911C and held in place via stitch line 930. Stitch line 930 also secures the elasticized sandwich that comprises portion 911A, elastic band 920, and portion 911C to leg or brief portion 940. Stitch line 950 strengthens the attachment of the brief or leg portion 910 to leg portion 940. In some embodiments include a third line of stitching that only goes through the leg fabric and one layer of the body fabric. Which is then folded over at the stitch to ensure that the edge of folded-over portion of the body fabric does not lift off the leg portion of the fabric. In some embodiments, the elastic band may be bonded or fused to portions 910 or 940, and/or the portions themselves may be bonded together rather than sewn together.

CONCLUSION

In the foregoing specification, specific exemplary embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A men's underwear assembly comprising:

an elastic waistband;

a spandex brief portion having left and right side panels joined at a central seam configured to encircle the waist, hips, and buttocks of a male human, with the left and right side panels respectively defining left and right leg openings configured to encircle respective right and left upper leg portions of the male wearer, and with the central seam having a front portion at least partially defining a shape of a genital pocket configured to contain male genitalia of the male human;

left and right spandex leg portions configured to encircle respective portions of the male wearer's left and right legs, each leg portion having an upper peripheral edge region and a lower peripheral edge region, with the upper peripheral edge region of each leg attached to a corresponding one of the left and right leg openings; and left and right elastic bands fastened jointly and peripherally to the respective left and right openings and to the respective left and right upper peripheral edge regions, and thereby defining respective left and right elastic boundaries of the genital pocket, wherein each of the left and right elastic bands have first and second end regions with the first end regions fastened to or adjacent a rear portion of the waistband, and the second end regions fastened to or adjacent a front portion of the waist band.

2. The assembly of claim 1, wherein the left and right elastic bands have a spring constant or elastic tension that is at least 20% greater than that of the spandex brief portion and that of the left and right spandex leg portions.

3. The assembly of claim 1, wherein a lowermost portion of each of the left and right leg bands defines a lower extent of the genital pocket and an upper most portion of each of the left and right leg bands is spaced in a range of 2-4 inches of a lower most edge of the waist band.

4. The assembly of claim 1, wherein the left and right leg openings of the brief are folded over to encase corresponding portions of the left and right elastic bands.

5. The assembly of claim 4, wherein the lower area of the man's leg is above the knee of the man's leg.

6. The assembly of claim 4, wherein the lower area of the man's leg is below the knee of the man's leg.

7. The assembly of claim 1, wherein the left and right upper peripheral edge regions of the leg portions are folded over to encase corresponding portions of the left and right elastic bands.

8. The assembly of claim 1, further comprising lower left and right elastic bands fastened peripherally to the respective left and right lower peripheral edge regions, each configured to encircle a respective lower area of a man's leg which is lower than the respective left and right elastic leg bands.

9. The assembly of claim 1, wherein each of the left and right elastic bands are formed of a braided elastic, and each have first and second end regions and the end regions are joined together defining a closed loop.

* * * * *